US005963188A

United States Patent [19]

Kim

[11] Patent Number: 5,963,188

[45] Date of Patent: Oct. 5, 1999

[54] GATE DRIVING CIRCUIT FOR LIQUID CRYSTAL DISPLAY

[75] Inventor: Young-Dae Kim, Seoul, Rep. of Korea

[73] Assignee: LG Electronics Inc., Seoul, Rep. of Korea

[21] Appl. No.: 08/810,027

[22] Filed: Mar. 4, 1997

[30] Foreign Application Priority Data

Mar. 26, 1996 [KR] Rep. of Korea ..... 96-8390

[51] Int. Cl.[6] ..... G09G 3/36

[52] U.S. Cl. ..... 345/98

[58] Field of Search ..... 345/100, 98, 90, 345/92

[56] References Cited

U.S. PATENT DOCUMENTS 5,194,853 3/1993 Asada ..... 345/100

5,666,131 9/1997 Togashi ..... 345/91

*Primary Examiner*—Mark R. Powell

*Assistant Examiner*—Thu Nguyen

*Attorney, Agent, or Firm*—Morgan, Lewis & Bockius LLP

[57] ABSTRACT

A gate driving circuit of an LCD having a data driver includes an output generator coupled to the data driver and generating a plurality of non-overlapping output signals from the data driver for driving a gate line, and a gate line level controlling unit coupled to the output generator and sequentially controlling a signal level of the gate line according to the non-overlapping output signals.

17 Claims, 10 Drawing Sheets

GATE DRIVING CIRCUIT FOR LIQUID CRYSTAL DISPLAY

BACKGROUND OF THE INVENTION

1. Field of the Invention

The present invention relates to a liquid crystal display (LCD), and more particularly, to a gate driving circuit of an active-matrix LCD.

2. Discussion of the Related Art

With reference to the attached drawings, a conventional gate driving circuit of LCD will now be described. As illustrated in FIG. 1, a conventional active-matrix panel includes a pixel array 1, a data driver 2, and a gate driver 3. Two clock signals ϕ1' and ϕ2', a horizontal start signal HST are input to the data driver 2 to produce data driving signals. Red (R), green (G) and blue(B) data signals are input to the pixel array 1 through passgate transistors by the data driving signals. Two clock signals ϕ1 and ϕ2 and a vertical start signal VST are input to the gate driver 3 to produce gate driving signals.

As illustrated in FIG. 2A, which is a conventional gate driving circuit, two clock inverters, a NAND gate, and four inverters are used for every stage.

As shown in the driving waveform of FIG. 2B, Q1 and Q2 overlap as illustrated because voltage Vdd is applied to the NAND gate of the first stage. Q2, Q3 and Q4 do not overlap each other because the signal from the previous terminal is applied to the corresponding NAND gates. That is, when signal VST is applied and signal ϕ2 is at a HIGH level, Q1 is at a HIGH level so that Q1 maintains the high level until ϕ2 becomes HIGH in the next time period. When ϕ1 becomes HIGH, Q2 is at a HIGH level. Here, Q2 maintains the high state until ϕ2 attains a high level. This is a typical characteristic of the NAND gate. That is, because the other input of the NAND gate is in a LOW state when ϕ2 is in a HIGH state, the output of the NAND gate is in a HIGH state, and as a result, the Q2 is changed to a LOW state when ϕ2 becomes HIGH. Q3 and Q4 are in their HIGH states without being overlapped with Q2.

As illustrated in FIG. 3A, the data driving circuit operates in the same manner as the gate driving circuit of FIG. 2A. That is, the output of the shift register serving as the data driver of each terminal is applied to the passgate transistor, thereby reading the R, G, B data in order to apply the R, G, B data to the data line.

Referring to FIG. 3B, the data driving waveform shows that the waveforms of Q1', Q2', Q3' and Q4' overlap one another. This prolongs the time to read the R, G, B data so as to be unaffected by TFT performance. Accordingly, even when the carrier mobility in the TFT is low, the shift register 2 serving as the data driver has sufficient time to read the data.

However, the conventional LCD gate driving circuit, as discussed above, has many defects due to a large number of TFTs forming the gate driver. The size of the panel is also increased by the large number of TFTs. The additional clock signals ϕ1 and ϕ2 required to operate the gate driver increase the cost. Furthermore, a ΔVp may exist for each pixel.

The ΔVp will be explained referring to FIGS. 4A and 4B. FIG. 4A is a diagram showing a conventional pixel array, and FIG.4B is a diagram showing a relationship between a gate voltage Vg and pixel charge voltages Vd and Vd'. In FIG.4A, Vcom is a voltage applied to the upper plate of a liquid crystal display, Ct is a pixel capacitance, and Cgs is a parasitic capacitance between the gate and the source of a TFT. The pixel capacitance Ct includes a liquid crystal capacitance Clc and a storage capacitance Cst. The ΔVp appears for a data value Vd charged in the pixel capacitance Ct, when the voltage Vg being applied to the gate changes to an OFF state from an ON state, where the pixel capacitance Ct is too small at the falling edge of the gate voltage Vg. The ΔVp can be expressed according to equation (1) below.

$$\Delta Vp = Cgs\ Vg/(Ct+Cgs) \ldots \quad (1)$$

As shown in FIG.4B, the data value Vd charged in the pixel capacitance decreases by ΔVp. Therefore, the data value Vd becomes Vd'. In general, it is possible to reduce ΔVp by increasing the pixel capacitance Ct. However, the amount of Ct that can be increased is limited and increasing Ct much greater than Cgs is difficult. The resultant value Vd' is different from the desired Vd by ΔVp, thereby affecting the picture quality of the liquid crystal display.

SUMMARY OF THE INVENTION

Accordingly, the present invention is directed to a gate driving circuit for liquid crystal display that substantially obviates one or more of the problems due to limitations and disadvantages of the related art.

An object of the invention is to provide a gate driving circuit for an LCD having a reduced number of TFTs forming the gate driver to thereby reduce the size of the panel.

Another object of the invention is to provide a gate driving circuit that drives the gate line without an additional clock signal, thereby reducing cost and eliminating the problem of ΔVp.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the gate driving circuit for a liquid crystal display includes an output generator to generate a plurality of non-overlapping output signals of a data driver for driving a gate line; and a gate line level controlling unit for sequentially controlling a signal level of the gate line according to each of the non-overlapping output signal.

In another aspect the gate driving circuit for a liquid crystal display includes an output generator to generate at least three non-overlapping output signals of a data driver for driving a gate line; and a gate line level controlling unit to sequentially control a signal level of the gate line, the gate line level controlling unit including a first passgate transistor to bypass a corresponding gate line signal according to a first non-overlapping output signal, a switching transistor to switch a corresponding gate line signal according to a second non-overlapping output signal, a NAND gate to produce a logical output according to the switching transistor and a third non-overlapping output signal, an inverter to invert the output of the NAND gate, and a second passgate transistor to bypass a gate line signal of a next stage according to a third non-overlap output signal.

In another aspect of the present invention, there is provided a gate driving circuit for LCD including means for generating a plurality of non-overlap output signals of a data driver for driving a gate line; and a gate line level controlling unit for sequentially controlling a signal level of the gate line according to each of the non-overlap output signal.

In another aspect of the present invention, there is a provided a method of driving an liquid crystal display device which comprises a plurality of gate lines and a data driver, comprising: generating a first signal and a second signal through the data driver, a time-interval from the first signal to the second signal being larger than a time-interval from the second signal to the first signal; charging one of the gate lines in response to the first signal; and discharging the charged gate line in response to the subsequent second signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
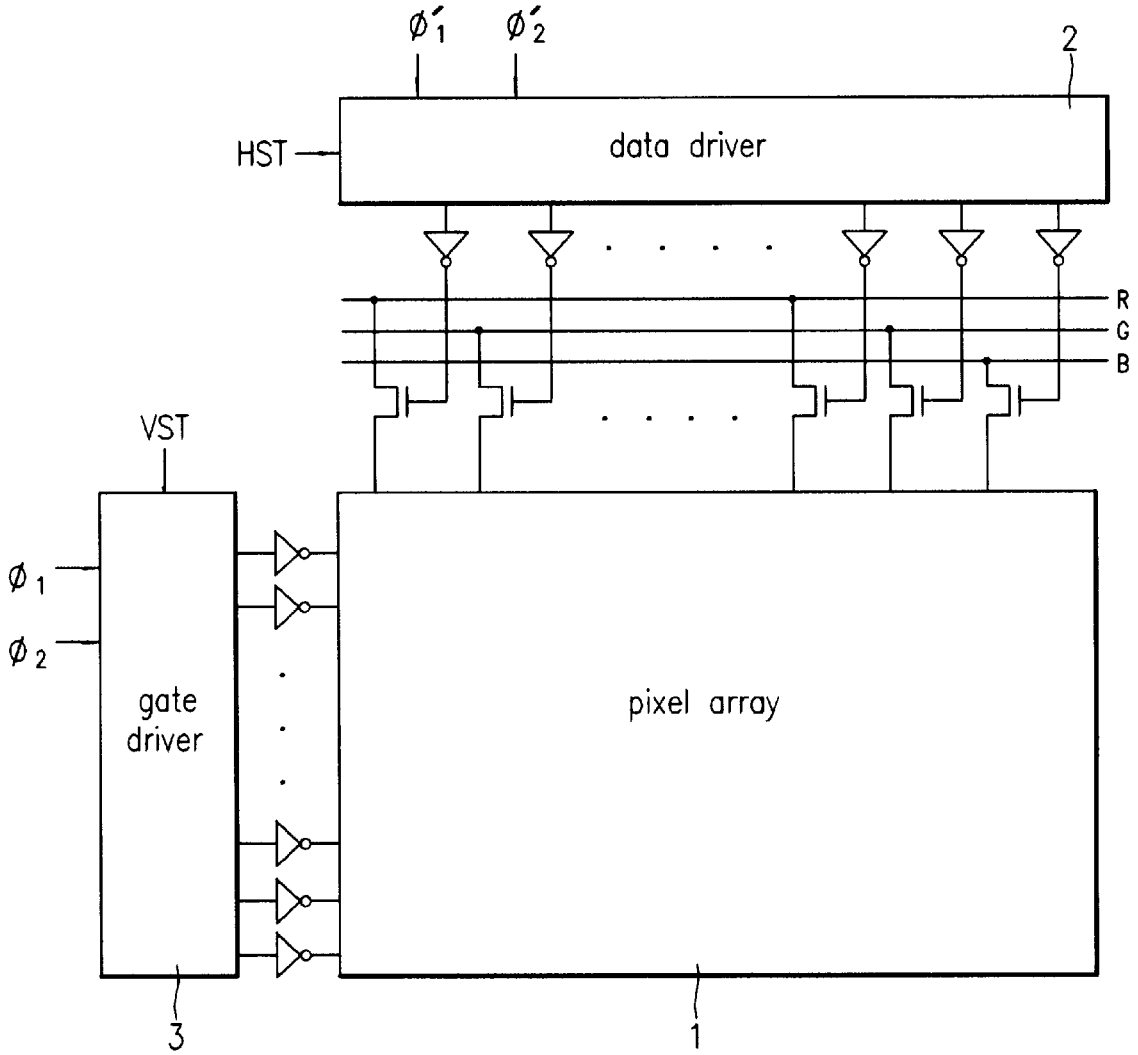
FIG.1 prior art
FIG. 1 is a schematic diagram of a conventional active matrix panel.
Figure 2A:
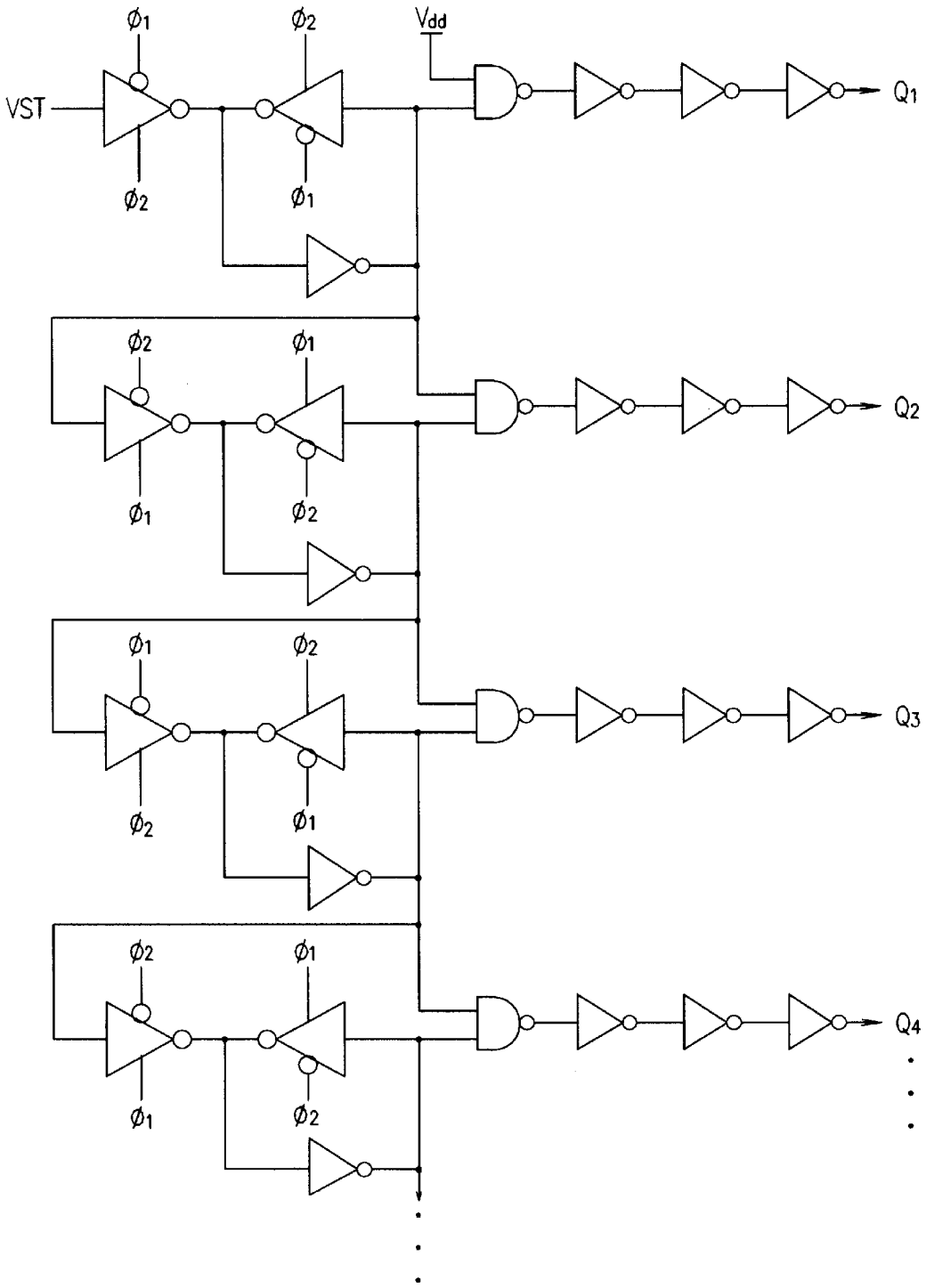
FIG.2A prior art
FIG. 2A is a diagram of a conventional gate driving circuit for an LCD.
Figure 2B:
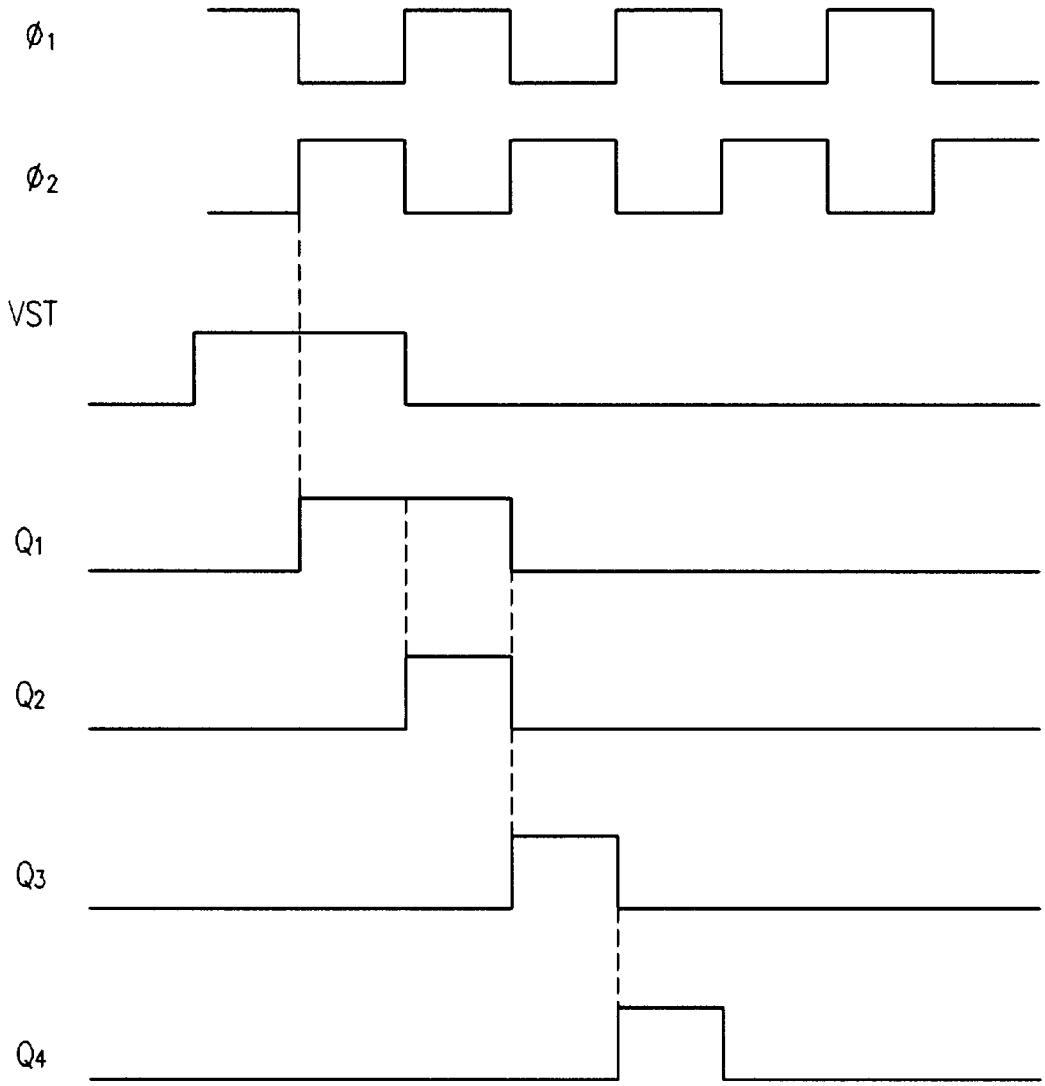
FIG.2B prior art
FIG. 2B shows conventional gate driving waveforms for an LCD.
Figure 3A:
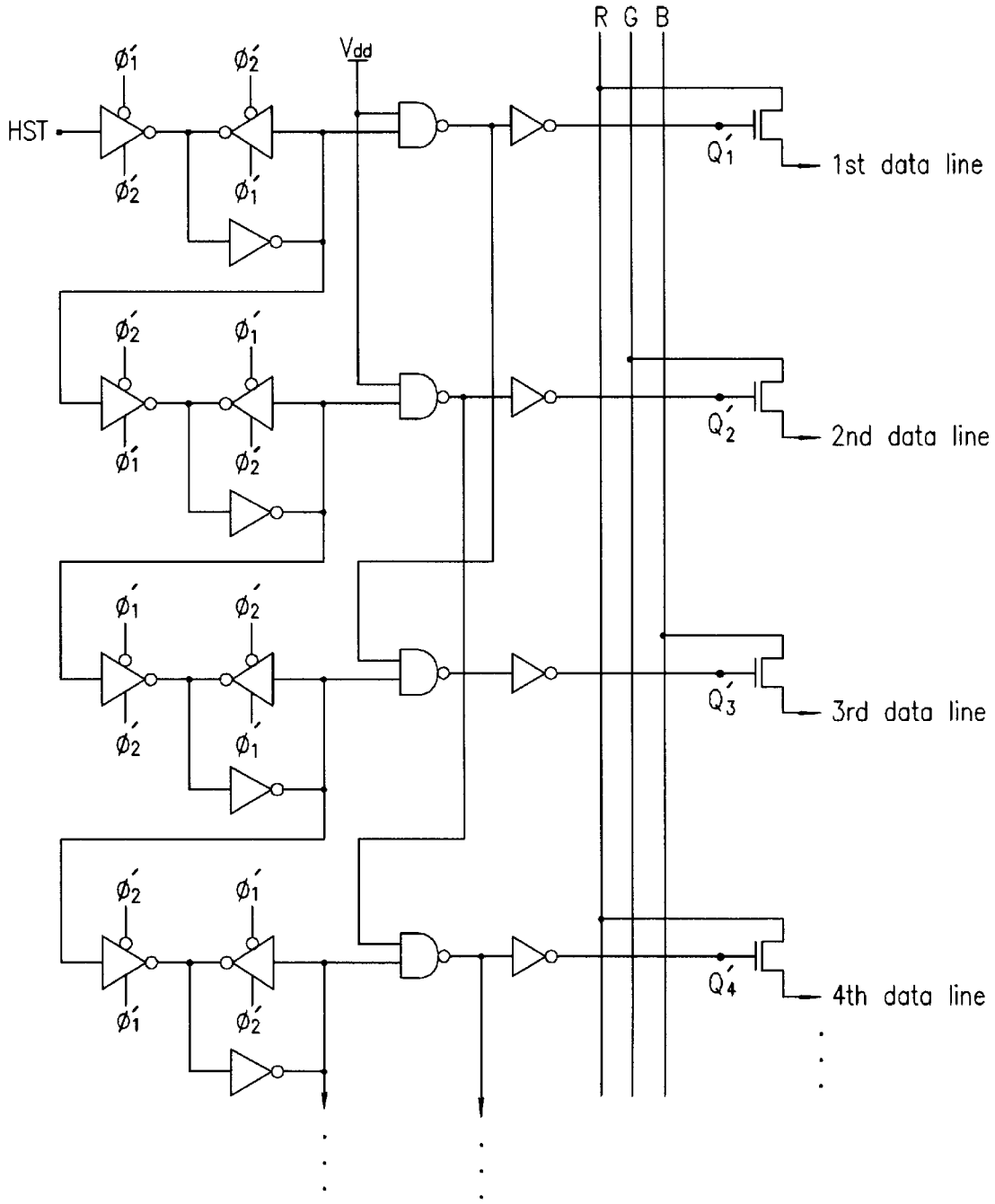
FIG.3A prior art
FIG. 3A shows conventional data driving circuit for an LCD.
Figure 3B:
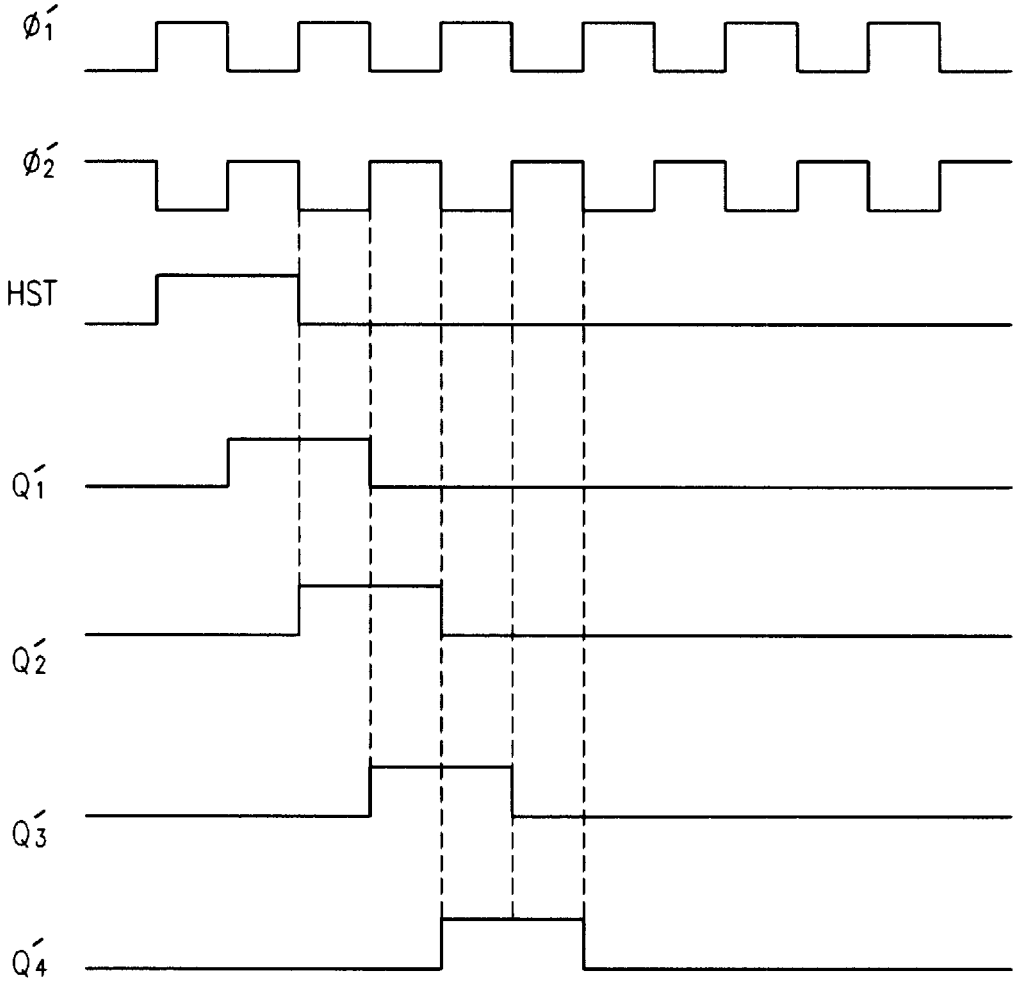
FIG.3B prior art
FIG. 3B shows conventional data driving circuit for an LCD.
Figure 4A:
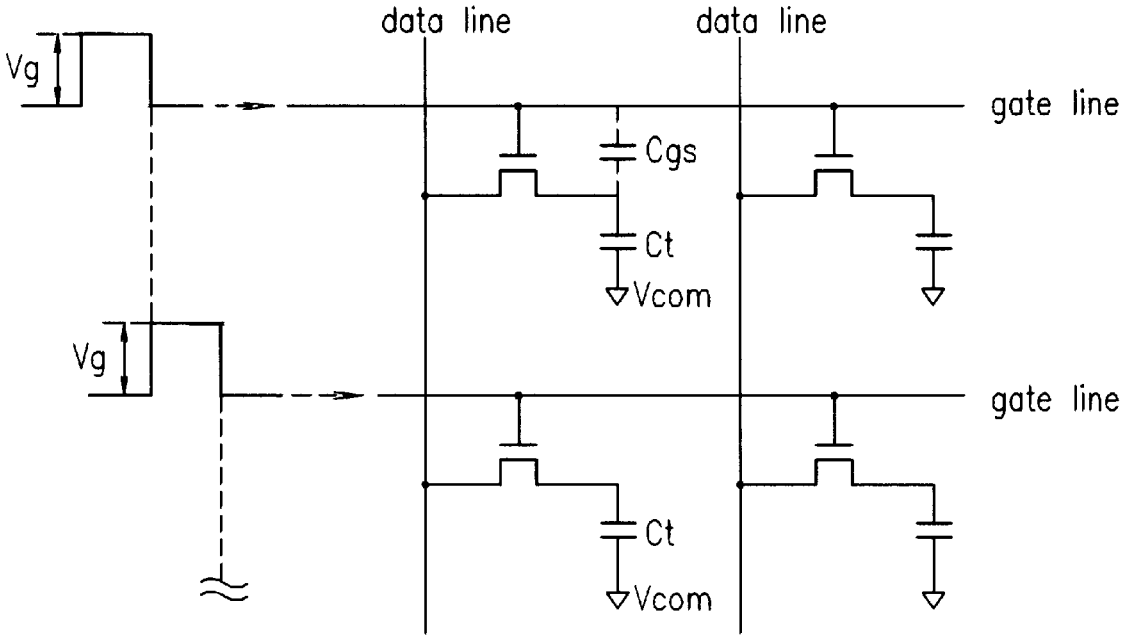
FIG.4A prior art
FIG. 4A shows a diagram of a conventional pixel array.
Figure 4B:
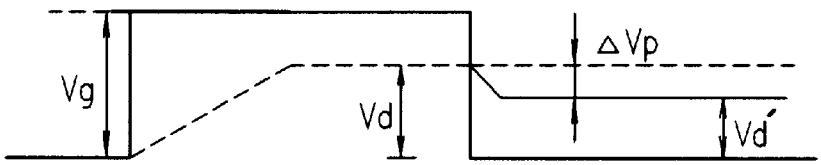
FIG.4B prior art
FIG. 4B shows a relationship between a gate voltage Vg and pixel charge voltages Vd,Vd'.
Figure 5:
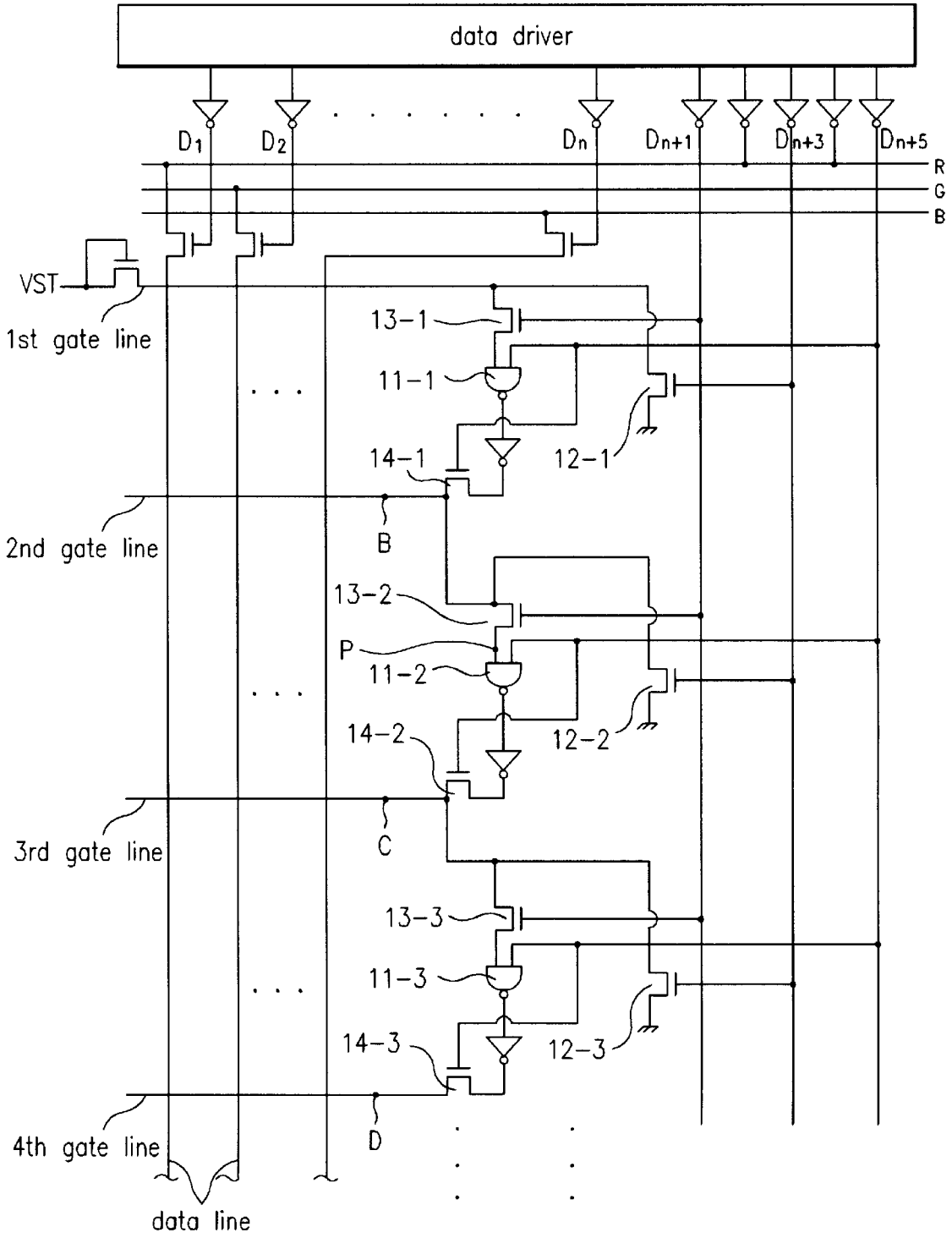
FIG. 5 shows a schematic diagram of a first embodiment of a gate driving circuit, including a gate line level controlling unit for an LCD in accordance with the present invention.

A gate driving circuit for an LCD of the present invention will now be described. As illustrated in FIG. 5, the gate driving circuit uses at least three non-overlapping signals $D_{n+1}$, $D_{n+3}$, and $D_{n+5}$ output from the second half portion of the data driver. Each stage of the gate driver has a NAND gate, an inverter, a first passgate transistor, a second passgate transistor, and a switching transistor.

Among the non-overlapping output signals $D_{n+1}$, $D_{n+3}$, and $D_{n+5}$ of the second half output portion of the data driver, the output signal $D_{n+5}$, is applied to one input terminal of each NAND gate of the gate driver, and the output signal $D_{n+3}$ is applied to the gate terminal of each first passgate transistor (12-1, 12-2, . . . ) of the gate driver. The output signal $D_{n+1}$ is applied to the gate terminal of each switching transistor (13-1, 13-2, . . . ) which switches a signal applied to each NAND gate(11-1, 11-2, . . . ) of the gate driver.

Accordingly, when the vertical start signal VST is applied to the gate driver, the first gate line becomes a HIGH state. Here, if the state of the output signal $D_{n+1}$ is HIGH, the switching transistor (13-1) is turned on, so that a HIGH level signal is input to the NAND gate (11-1).

Thereafter, when the output signal $D_{n+3}$ is in a HIGH state, the passgate transistor (12-1) is turned on, so that the signal of the first gate line is bypassed through the passgate transistor (12-1). Therefore, the signal of the first gate line becomes a LOW state.

Subsequently, when the output signal $D_{n+5}$ is at a HIGH state, the passgate transistor (14-1) connected to the second gate line is turned on, so that the second gate line becomes a HIGH state. Here, when the gate line is in a HIGH state, the output signals of the data driver D1 to Dn are output from the data driver and applied to the data lines. Then, when the output signal $D_{n+1}$ from the data driver is changed from a LOW state to a HIGH state, the switching transistor (13-2) of the second stage of the gate driver is turned on, so that the NAND gate (11-2) receives a HIGH signal of the second gate line.

At this time, if the output signal $D_{n+3}$ becomes a HIGH state, the passgate transistor (12-2) of the second stage is turned on, and bypasses the HIGH signal of the second gate line, so that the second gate line changes from a HIGH state to a LOW state.

Then, when the output signal $D_{n+5}$ becomes a HIGH state, the third gate line becomes a HIGH state. The third gate line maintains the floating HIGH state, while D1 through Dn are output by the data driver according to the HIGH state signal of the third gate line. Thereafter, once the output signal $D_{n+1}$ becomes a HIGH state again, the switching transistor (13-3 of each third terminal of the gate driver is turned on, so that the HIGH signal of the third gate line is input to the NAND gate (11-3). Pulses are sequentially applied to all of the gate lines in order by repeating this operation.

Figure 6A:
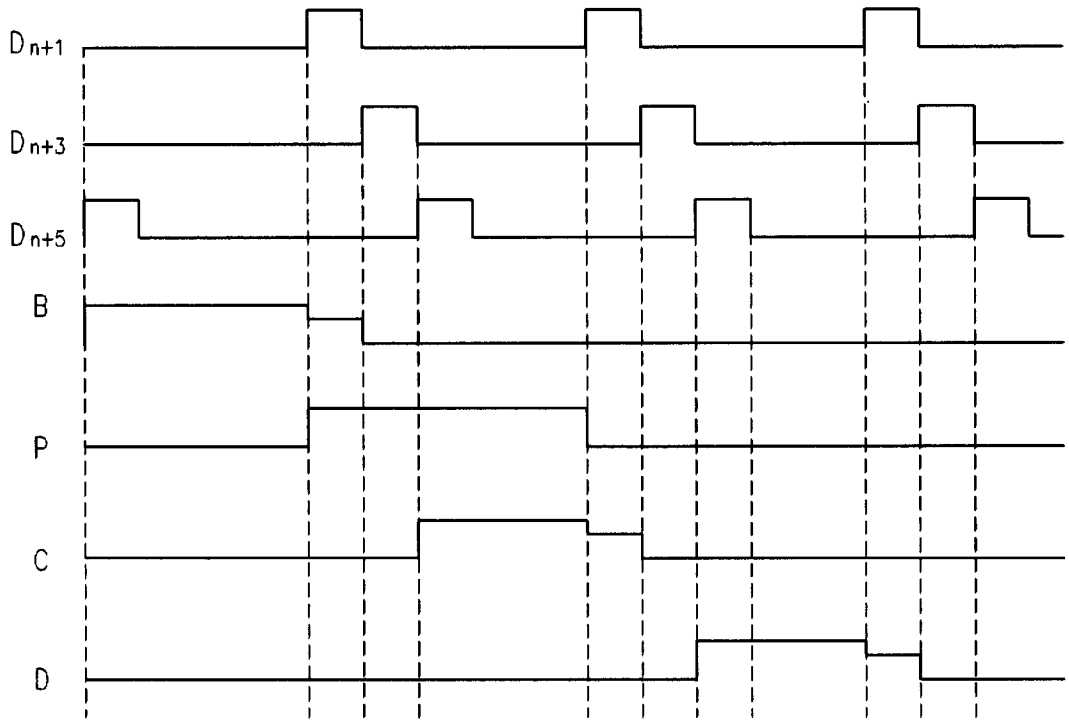
FIG. 6A shows gate driving waveforms according to the circuit of FIG. 5.

FIG. 6A illustrates the waveforms at points B, P, C, D in the circuit of FIG. 5.

As illustrated in FIG. 6A, at the moment that the switching transistor 13-3 is turned on by the output signal $D_{n+1}$, the falling edge of the waveform at the point C of the third gate line slightly drops. Here, when the $D_{n+3}$ becomes a HIGH state, the passgate transistor 12-3 of the third stage is turned on, so that the third gate line becomes completely a LOW state.

In such a manner, since the level of the falling edge of the waveform of each gate line drops in two stages, the value of $\Delta Vp$ for the pixel decreases, thereby advantageously compensating for the flickering of each pixel. As mentioned above, the gate lines are charged and then discharged in order in response to the non-overlapping signals $D_{n+1}$, $D_{n+3}$, and $D_{n+5}$ from the data driver. Here, the time interval when $D_{n+1}$, and $D_{n+5}$ are turned on is controlled considering the pixel charging time.

The above embodiment illustrates a HIGH state transitioning to a LOW state in two stages. It is also possible in the present invention to change a HIGH state to a LOW state over multiple stages greater than two. Moreover, although the above-embodiment illustrates a method of driving a gate driver with only three non-overlapping signals, the method can also be applied to a data driver in a similar fashion.

Figure 6B:
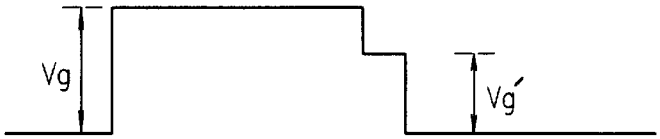
FIG. 6B shows a shape of a gate voltage to be applied to each gate line according to the present invention.

FIG. 6B shows a shape of a gate voltage Vg to be applied to each gate line according to the present invention. As shown in FIG. 6B, the falling edge of the gate voltage Vg in the present invention drops in two stages to a low state when it is turned off. Based on the above-explanation, the above-equation (1) can be replaced by the equation (2) below.

$$\Delta Vp = Cgs\ Vg'/(Ct+Cgs) \ldots \quad (2)$$

Since Vg' is less than Vg, the value ΔVp is lower than in equation (1).

Figure 7:
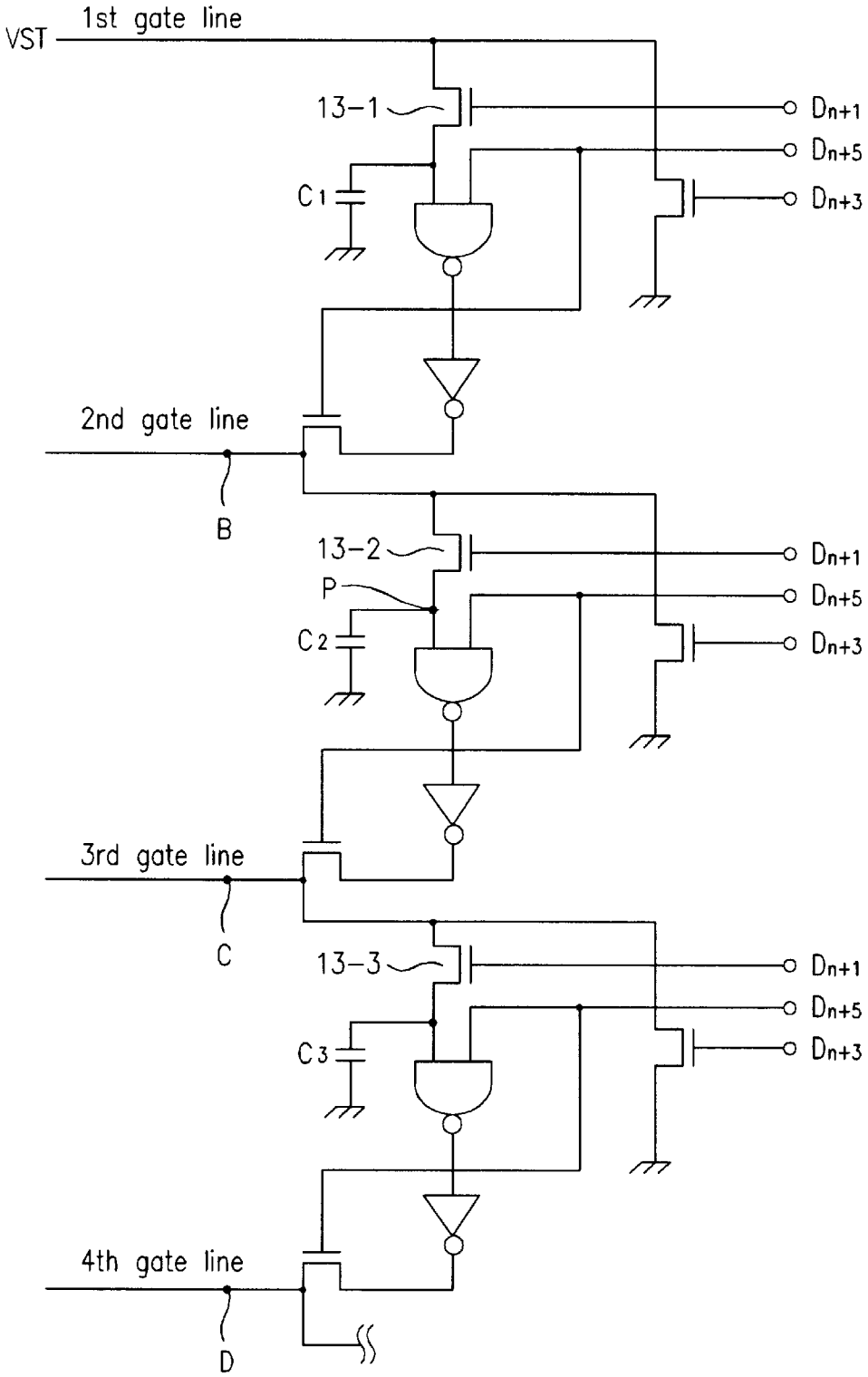
FIG. 7 shows a second embodiment of a gate line level controlling unit of the present invention.

FIG. 7 shows the gate driving circuit of an LCD of the present invention where the level of the falling edge of the gate line driving waveform slightly drops in stages by additionally employing capacitors C1, C2, and C3 at each switching transistor 13-1, 13-2, 13-3 of each terminal. Therefore, it is possible to reduce the ΔVp even more. The waveforms for points B, P. C, D in FIG.7 are similar to the waveforms of FIG.6.

Figure 8:
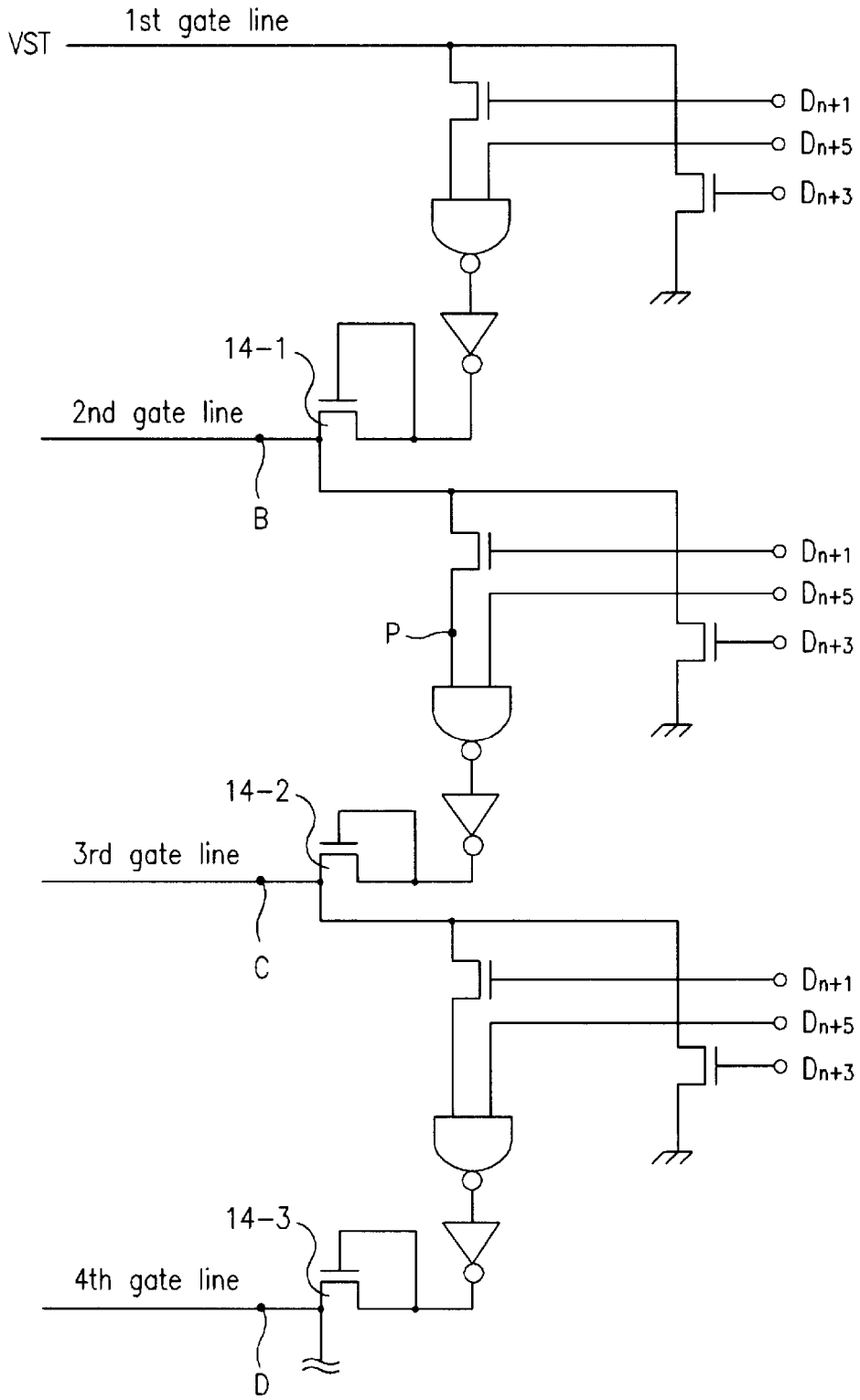
FIG. 8 shows a third embodiment of a gate line level controlling unit of the present invention.

FIG. 8 shows the second passgate transistors 14-1, 14-2, 14-3 that are the same as n-type TFTs illustrated in FIG. 5, where the source and gate terminals, or the drain and gate terminals are used in common in order to reduce ΔVp. The waveforms for points B, P, C, D of FIG. 8 are also similar to the waveforms of FIG. 6.

The gate driving circuit of the present invention described above has at least the following advantages: (1) decreases cost by driving the gate lines without an additional clock, (2) reduces defects and the size of the panel by reducing the number of TFTs, and (3) solves the problem of ΔVp in accordance with the driving waveform of the gate line.

It will be apparent to those skilled in the art that various modifications and variations can be made in the gate driving circuit for liquid crystal display of the present invention without departing from the spirit or scope of the invention. Thus, it is intended that the present invention cover the modifications and variations of this invention provided they come within the scope of the appended claims and their equivalents.

What is claimed is:

1. A driving circuit for an LCD comprising:

a data driver having an output generator, the output generator generating first and second waveforms each having a plurality of pulses; and a gate line level controlling unit coupled to the output generator and sequentially controlling a signal level of the gate line in response to the first and second waveforms, wherein the gate line is charged in response to a first pulse of the first waveform and discharged in response to a first pulse of the second waveform, and wherein the first pulse of the first waveform and the first pulse of the second waveform do not overlap with each other.

2. The driving circuit for an LCD according to claim 1, wherein the gate line level controlling unit includes:

a first switching device coupled to the gate line, a second switching device for discharging the gate line, and a third switching device for charging a next gate line, wherein the first waveform controls one of the first and second switching devices, and the second waveform controls the third switching device.

3. The driving circuit for an LCD according to claim 2, wherein the first switching device partially discharges the gate line.

4. The driving circuit for an LCD according to claim 2, wherein the gate line level controlling unit further includes a logic circuit coupled between the first and third switching devices.

5. The driving circuit for an LCD according to claim 2, wherein the gate line level controlling unit further includes a capacitor coupled to the first switching device.

6. A driving circuit for an LCD comprising:

a data driver having an output generator, the output generator generating a plurality of non-overlapping output signals; and a gate driver having a gate line level controlling unit coupled to the output generator and sequentially controlling a signal level of the gate line according to the non-overlapping output signals, wherein the gate line level controlling unit includes a first transistor bypassing a corresponding gate line signal according to a first one of the non-overlapping output signals;

a second transistor switching the corresponding gate line signal according to a second one of the non-overlapping output signals;

a logic gate unit coupled to the second transistor and producing a logical output signal according to the second transistor; and a third transistor producing a gate line signal of a next stage according to a third one of the non-overlapping output signals.

7. The driving circuit for an LCD according to claim 6, wherein the logic gate unit includes an NAND gate connected to an inverter, the inverter being connected to the third passgate transistor.

8. The driving circuit for an LCD according to claim 6, wherein the gate line level controlling unit further comprises a capacitor coupled to the second transistor.

9. The driving circuit for an LCD according to claim 8, wherein the capacitor drops a falling edge of a gate line driving waveform in multiple stages.

10. The driving circuit for an LCD according to claim 6, wherein a gate of the third transistor is connected to one of a source and a drain of the third transistor.

11. A gate driving circuit for an LCD having a data driver, comprising:

an output generator coupled to the data driver and generating at least three non-overlapping output signals from the data driver for driving a gate line; and a gate line level controlling unit coupled to the output generator and sequentially controlling a signal level of the gate line according to the non-overlapping output signals, the gate line level controlling unit including:

a first passgate transistor bypassing a corresponding gate line signal according to a first one of the non-overlapping output signals;

a switching transistor switching the corresponding gate line signal according to a second one of the non-overlapping output signals;

an NAND gate coupled to the switching transistor and producing a logical output signal according to an operating state of the switching transistor and a third one of the non-overlapping output signals;

an inverter for inverting the output of the NAND gate; and a second passgate transistor producing a gate line signal of a next stage according to the second non-overlapping output signal.

12. The gate driving circuit for an LCD according to claim 11, wherein the gate line level controlling unit further comprises a capacitor coupled to the switching transistor, the capacitor dropping the falling edge of the gate line driving waveform in multiple stages.

13. The gate driving circuit for an LCD according to claim 11, wherein a gate of the second passgate transistor is connected to one of a source and a drain of the second passgate transistor.

14. A method of driving a liquid crystal display device including a plurality of gate lines and a data driver, the method comprising the steps of:

producing a first waveform having a plurality of pulses and a second waveform have a plurality of pulses, in order, through the data driver, a time-interval from a first one of the pulses of the first waveform to a first one of the pulses of the second waveform being larger than a time-interval from the first one of the pulses of the second waveform to a second one of the pulses of the first waveform;

charging one of the gate lines in response to the first one of the pulses of the first waveform; and discharging the charged gate line in response to the first one of the pulses of the second waveform.

15. A method of driving a liquid crystal display device including a gate line and a data driver, the method comprising the steps of:

generating first and second waveforms from the data driver, the first and second waveforms each having a plurality of pulses; and sequentially controlling a signal level of the gate line in response to the first and second waveforms from the data driver, wherein the step of sequentially controlling includes charging the gate line in response to a first pulse of the first waveform, and discharging the gate line in response to a first pulse of the second waveform, wherein the first pulse of the first waveform and the first pulse of the second waveform do not overlap with each other.

16. A method of driving a liquid crystal display device including a gate line and a data driver, the method comprising the steps of:

generating a plurality of non-overlapping output signals from the data driver; and sequentially controlling a signal level of the gate line according to the non-overlapping output signals from the data driver, wherein the signal level controlling step comprises the steps of bypassing a corresponding gate line signal according to a first one of the non-overlapping output signals;

switching the corresponding gate line signal according to a second one of the non-overlapping output signals;

producing a logical output signal according to the switched signal from the switching step; and producing a gate line signal of a next stage according to a third one of the non-overlapping output signals.

17. The method according to claim 16, wherein a gate line driving pulse waveform of the gate line signal transitions from one logic state to another logic state in multiple stages, each stage corresponding to a different level.

* * * * *